US009622641B1

(12) United States Patent
Bambino

(10) Patent No.: US 9,622,641 B1
(45) Date of Patent: Apr. 18, 2017

(54) CLEANING PAD WITH INTEGRATED FORK SCRUBBER

(71) Applicant: Philip Bambino, Woodbury, CT (US)

(72) Inventor: Philip Bambino, Woodbury, CT (US)

( * ) Notice: Subject to any disclaimer, the term of this patent is extended or adjusted under 35 U.S.C. 154(b) by 0 days.

(21) Appl. No.: 15/165,631

(22) Filed: May 26, 2016

(51) Int. Cl.
*A47L 17/00* (2006.01)
*B08B 1/00* (2006.01)

(52) U.S. Cl.
CPC ..... *A47L 17/00* (2013.01); *B08B 1/006* (2013.01)

(58) Field of Classification Search
CPC ..... A47L 17/00; A47L 21/00; A47L 21/04
USPC ..... 15/104.5, 118, 218.1
See application file for complete search history.

(56) References Cited

U.S. PATENT DOCUMENTS 3,230,571 A * 1/1966 Mayer ..... A47L 21/00 15/104.93
3,775,014 A * 11/1973 Rosborne ..... A47L 13/17 15/104.94
4,457,643 A * 7/1984 Caniglia ..... A47K 7/03 401/200
5,191,670 A * 3/1993 Lake ..... A46B 15/00 15/160
8,966,702 B1 * 3/2015 Green ..... A47L 17/00 15/218.1
2004/0088810 A1 * 5/2004 Britt ..... A47L 17/08 15/118

* cited by examiner

*Primary Examiner* — Nicole Blan
(74) *Attorney, Agent, or Firm* — R. Neil Sudol; Henry D. Coleman

(57) ABSTRACT

A dish cleaning pad has a pair of sidewalls defining a pocket therebetween. The sidewalls are formed with a pair of mutually aligned windows. A planar insert is disposed in the pocket, the insert having an aperture aligned with the windows in the pad sidewalls. The aperture in the insert is formed with a multiplicity of parallel tines each connected at opposite ends to edges of the planar insert on opposite sides of the aperture.

12 Claims, 2 Drawing Sheets

CLEANING PAD WITH INTEGRATED FORK SCRUBBER

BACKGROUND OF THE INVENTION

This invention relates to a kitchen cleaning tool. More particularly, this invention relates to a dish-washing sponge or pad.

Washing dishes can always be a problem depending, for instance, on the degree of dryness of food residue on the dishes and utensils. This problem is compounded when the food residue is in locations that are difficult to access with conventional cleaning implements such as sponges and pads. Removing food particles from between the tines or prongs of forks is especially difficult. Pads and sponges are too bulky to access the gaps between the fork prongs.

OBJECTS OF THE INVENTION

It is accordingly an object of the present invention to provide a kitchen tool or implement that particularly addresses the structure of forks.

Another object of the present invention is to provide an improved kitchen sponge or pad that is useful for cleaning forks.

A further object of the present invention is to provide such a tool, implement, sponge or pad that is easy to use.

Another object of the present invention is to provide such a tool, implement, sponge or pad that is inexpensive to manufacture.

These and other objects of the invention will be apparent from the drawings and descriptions herein. Although every object of the invention is attained in at least one embodiment of the invention, there is not necessarily any embodiment which attains all of the objects of the invention.

SUMMARY OF THE INVENTION

A kitchen cleaning tool comprises, in accordance with a preferred embodiment of the present invention, a dish cleaning pad having a pair of sidewalls defining a pocket therebetween. The sidewalls are formed with a pair of mutually aligned windows. A planar insert is disposed in the pocket, the insert having an aperture aligned with the windows in the pad sidewalls. The aperture in the insert is formed with a multiplicity of preferably parallel tines each connected at opposite ends to edges of the planar insert on opposite sides of the aperture.

The tines are preferably in the form of tapered teeth, similar to comb teeth, but may alternatively take the form of tough but flexible threads or filaments or wires. The tines are preferably made of the same material as the body of the insert. The tines are generally located in a common plane, that of the insert body.

The pad may have an elongate rectangular form with the windows eccentrically disposed proximate a peripheral edge of the pad. The pad can therefore be used in a conventional manner to clean broad surfaces of dishes and utensils. In a fork-cleaning mode, the pad is held in one hand with the pad oriented generally parallel to the palm surface. The insert is stiff enough to permit the pad to be held in compression between opposing edges with the mutually aligned pad windows and inset aperture located away from the hand. The user grasps the handle of a fork with his or her other hand and passes the prongs of the fork in a direction that is generally perpendicular to the common plane of the tines so that one or more tines are inserted between each of two adjacent fork prongs. This passing of the fork prongs through the array of tines may be performed multiple times to ensure a dislodging of recalcitrant food particles from between the fork prongs.

The array of closely spaced tines may be coextensive with the insert aperture. Alternatively the array of closely spaced tines may occupy only a portion of the insert aperture and concomitantly only a portion of each of the pad windows. The remainder of the opening through the pad, which is defined by the sidewall windows and the insert's aperture, may be open or vacant. In that case, the array of tines may be centrally located, with open window space on each side, or located to one side of the composite window and aperture, with the open space on the other side.

It is contemplated that the tines extend in a direction perpendicular to the peripheral edge of the pad, that is longitudinally or parallel to a long axis of the pad.

It is further contemplated that the pad windows and the insert aperture are mutually coextensive. However, it is possible for the insert aperture to be smaller than the windows in the pad sidewalls so that the insert is visible through the windows. It is also possible for the insert aperture to be larger than the windows in the pad sidewalls so that the pad material extends into the insert aperture along one or more edges thereof.

In preferred embodiments of the present invention, the pad windows and the insert aperture are rectangular. However other geometric shapes may be used, such as oval or circular.

The tines may be unitary with the planar insert. This is the case for instance if the insert is manufactured as a single sheet of polymeric material which is then sliced along multiple parallel lines to form the tines and the aperture. Alternatively the insert body may be made of one material such as polymer while the tines are made of a different material such as metal or alloy wire.

The tines are preferably disposed adjacent one another and spaced from one another by a distance less than a width of a fork prong. The tines are sufficiently flexible to permit simultaneous insertion of prongs of a fork between respective adjacent tine pairs. The flexibility of the tines enables effective use of the device with different forks having respective prongs of different widths and spacings.

In a preferred embodiment, the insert is nearly coextensive with the pad. However it is possible that the pocket and the insert are smaller than the pad and are located at only one end thereof.

In cleaning kitchen utensils using a tool in accordance with the present invention, one can use the pad in a conventional manner by rubbing an outer surface of the pad against a dish to remove food particles from the dish. The peculiar use of the device in accordance with present invention comprises inserting prongs of a fork substantially simultaneously between respective adjacent ones of the tines. The fork may be moved in a back-and-forth motion alternating the pressure of the fork from one side to another to vary the scraping pressure applied by the tines to the inside edges or surfaces of the fork prongs.

In accordance with another embodiment of the present invention, a kitchen cleaning tool comprises a planar body member having an aperture and a multiplicity of preferably parallel tines each connected at opposite ends to edges of the planar body member on opposite sides of the aperture.

Pursuant to further features of the present invention, (a) the body member is elongate and the aperture is eccentrically disposed in the planar body member, proximate a peripheral edge thereof, (b) the tines extend in a direction perpendicular to the peripheral edge, (c) the aperture is rectangular, (d) the tines are unitary with the planar body member, (e) the tines and the planar body member are made of a polymeric material, (f) the tines are disposed adjacent one another, adjacent tines being spaced from one another by a distance less than a width of a fork prong, the tines being sufficiently flexible to permit simultaneous insertion of prongs of a fork between respective adjacent pairs of the tines. These various features and others described herein can be mixed and matched in any combination to produce various modified versions of the device or tool.

DETAILED DESCRIPTION

Figure 1:
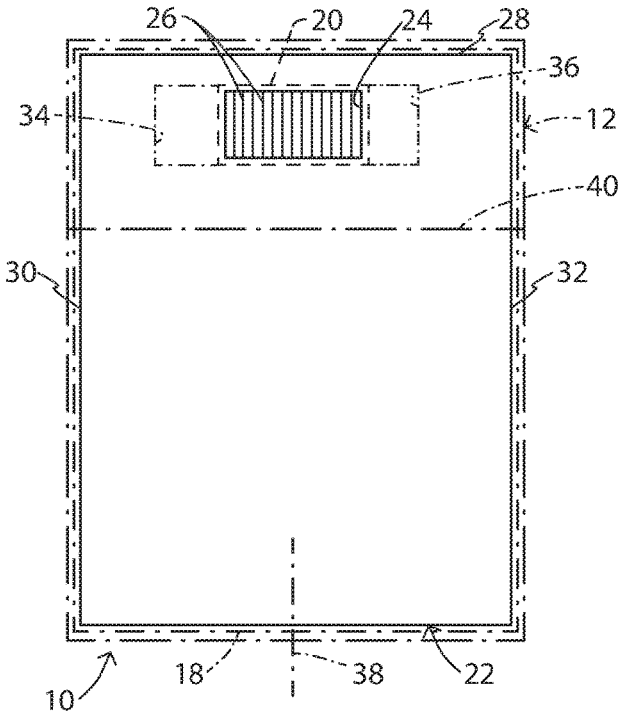
FIG. 1 is a schematic front elevational view of a fork-cleaning device in accordance with the present invention configured as an insert for a dish cleaning pad or sponge shown in phantom lines.
Figure 2:
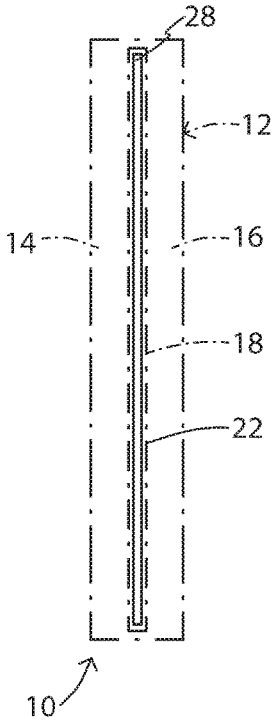
FIG. 2 is a schematic side elevational view of the cleaning device of FIG. 1, also showing a dish cleaning pad or sponge in phantom lines.
Figure 3:
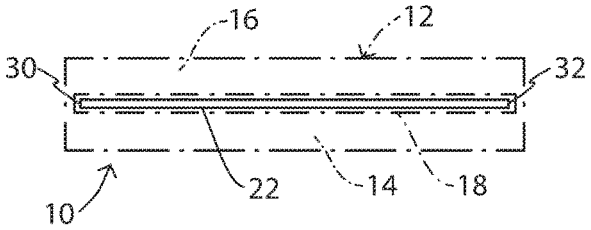
FIG. 3 is a schematic top plan view of the cleaning device of FIGS. 1 and 2, showing a dish cleaning pad or sponge in phantom lines.

As depicted in FIGS. 1-3, a kitchen cleaning tool 10 comprises a dish cleaning pad 12 having a pair of sidewalls 14, 16 defining a pocket 18 therebetween. Pad 12 may be made of any material suitable for dish cleaning, including sponge material, nonwoven fabric material or terrycloth. For instance, pad 12 may be a foam sponge optionally covered with a nylon mesh.

Sidewalls 14, 16 of pad 12 are formed with a pair of mutually aligned windows 20 (only one shown). A planar insert member or body 22 is disposed in pocket 18. Insert member 22 has an aperture 24 aligned with windows 20 in pad sidewalls 14 and 16. Aperture 24 is formed with an array of parallel tines 26 each connected at opposite ends to edges (not separately enumerated) of insert member 22 on opposite sides of aperture 24.

After a placement of insert member 22 into pocket 18, sidewalls 14 and 16 of the pad 12 may be fastened to one another to lock insert member 22 in the pocket. The fastening may be implemented by sewing, gluing or stapling. Alternatively, releasable fasteners such as snap-lock elements, hook and loop elements (VELCRO) or hook and eyelets may be used.

Tines 26 are preferably tough but flexible prongs or teeth made of the same material as the body of the insert. Tines 26 are generally located in a common plane, that of the insert body 22.

As depicted in the drawings pad 12 may have an elongate rectangular form with windows eccentrically disposed proximate a peripheral edge 28 of pad 12.

Pad 12 is utilizable in a conventional manner to clean broad surfaces of dishes and utensils. In a fork-cleaning mode, pad 12 is held in one hand with the pad and insert body 22 oriented generally parallel to the palm surface. Insert 22 is stiff enough to permit the pad 12 to be held in compression between opposing edges 30 and 32 with the mutually aligned pad windows 20 and insert aperture 24 located away from the hand. The user grasps the handle of a fork with his or her other hand and passes the prongs of the fork in a direction that is generally perpendicular to the common plane of the tines 26 so that one or more tines are inserted between each of two adjacent fork prongs. This passing of the fork prongs through the array of tines 26 may be performed multiple times to ensure a dislodging of recalcitrant food particles from between the fork prongs.

Figure 4:
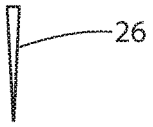
FIG. 4 is a schematic side elevational view of a fork-cleaning tine included, in the cleaning device of FIGS. 1-3.
Figure 5:
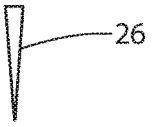
FIG. 5 is a schematic front elevational view of the fork-cleaning tine shown in FIG. 4.

As illustrated in FIGS. 4 and 5, each individual tine 26 may have a tapered profile. Preferably, each tine has a relatively pronounced taper, shown in FIG. 5, in the plane of the insert body 22 and a slighter taper in a plane perpendicular to the insert body 22. Thus, FIG. 5 shows a tine profile as seen in the front elevational view of FIG. 1, while FIG. 4 shows the individual tine 26 from the point of view of FIG. 4. The tapered profile of FIGS. 4 and 5 facilitates cleaning of fork prongs in that prongs of different sizes and spacings are more easily accommodated. Different forks may be inserted through tines 26 at points at different distances from pad edge 28 depending on the prong geometry.

Alternatively, tines 26 may be rectangular in cross-section. In another configuration, tines 26 may each have one of several different geometries. Some tines 26 may be elongate prismatic in form, while others are distended pyramids as illustrated in FIGS. 4 and 5.

Figure 6:
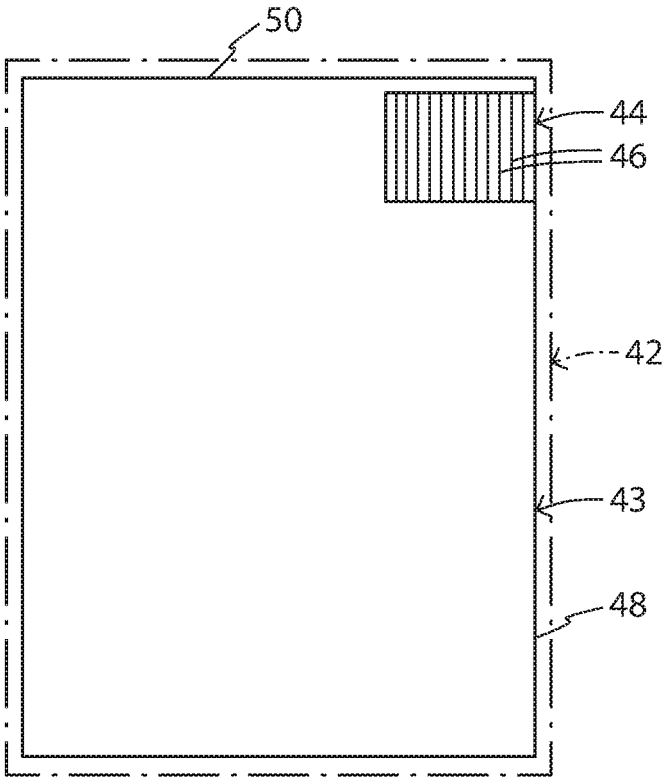
FIG. 6 is a schematic front elevational view of a fork-cleaning device in accordance with the present invention configured as an insert for a dish cleaning pad or sponge, shown in phantom lines.

FIG. 1 depicts aperture 24 as being centrally located midway between longitudinal pad edges 30 and 32. Alternatively, as depicted in FIG. 6, a pad 42 may enclose an insert body 43 with an array 44 of tines 46 eccentrically at one longitudinal edge 48 of the pad. Tine array 44 is also located, in the embodiment of FIG. 6 along a short or transverse edge 50 of pad 42.

Tines 26 may collectively occupy the entire insert aperture 24, as shown in FIG. 1. Alternatively the array of tines 26 may occupy only a portion of the insert aperture 24 and concomitantly only a portion of each of the pad windows 20. Thus windows 20 and aperture 24 may have one or two open areas 34 and 36 (FIG. 1).

Tines 26 extend in a direction perpendicular to peripheral edge 28 of pad 12, that is, longitudinally or parallel to a long axis 38 of the pad. Pad windows 20 and insert aperture 24 are typically mutually coextensive. However, it is possible for insert aperture 24 to be smaller than windows 20 that the insert body 22 is visible through the windows 20. It is also possible for insert aperture 24 to be larger than windows 20 so that the material of pad 12 extends over insert aperture 24 along one or more edges thereof.

Inserts 22 are manufactured, for instance, by cutting a sheet of polymeric material into rectangles and then slicing each rectangle along multiple parallel lines to form the tines 26 and concomitantly aperture 24. Alternatively insert body 22 may be made of a first material such as polymer while tines 26 are made of a second material such as metal or alloy wire. In that case, the tine wires are anchored to a metal frame (not shown) which is embedded in the insert body 22 around the aperture 24.

In one preferred configuration, tines 26 are spaced from one another by a distance less than a width of a fork prong. The tapered tine design particularly of FIG. 5 has a variable inter-tine spacing that adapts the cleaning device to forks having prongs of different widths and spacing. Tines 26 may be formed with a certain flexibility to permit simultaneous insertion of prongs of a fork between respective adjacent tine pairs, while permitting a bending of the tines.

As illustrated in FIGS. 1-3, insert body 22 may be nearly coextensive with pad 12. However it is possible that pocket 18 and insert 22 are smaller than pad 12 and are located at only one end thereof, as indicated by a line 40 in FIG. 1.

In cleaning kitchen utensils using pad 12 with insert 22 and tines 26, one can use pad in a conventional manner by rubbing an outer surface of the pad against a dish to remove food particles from the dish. To clean a fork, one inserts the fork prongs substantially simultaneously between respective adjacent ones of the tines 26. Where the tines are wires, filaments or linear prisms (i.e., not tapered), the fork may be moved in a back-and-forth motion alternating the pressure of the fork from one side to another to vary the scraping pressure applied by the tines 26 to the inside edges or surfaces of the fork prongs. In the case of tapered tines 26 as shown in FIG. 5, one moves the fork longitudinally, parallel to axis 38 until suitable pressure is applied against the prong edges.

It is to be noted that insert 22 may be provided as a dedicated tool, without pad 12. Insert 22 is preferably made of a flexible polymeric material such as polyurethane.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A kitchen cleaning tool comprising:

a dish cleaning pad having a pair of sidewalls defining a pocket therebetween, said sidewalls being formed with a pair of mutually aligned windows; and a planar insert disposed in said pocket, said insert having an aperture aligned with said windows, said aperture being formed with a multiplicity of tines each connected at opposite ends to edges of said planar insert on opposite sides of said aperture.

2. The tool defined in claim 1 wherein said pad is elongate and said windows are eccentrically disposed in said pad, proximate a peripheral edge thereof.

3. The tool defined in claim 2 wherein said tines extend in a direction perpendicular to said peripheral edge.

4. The tool defined in claim 1 wherein said windows and said aperture are mutually coextensive.

5. The tool defined in claim 1 wherein said windows and said aperture are rectangular.

6. The tool defined in claim 1 wherein said tines are unitary with said planar insert.

7. The tool defined in claim 1 wherein said tines and said planar insert are made of a polymeric material.

8. The tool defined in claim 1 wherein said planar insert is made of a flexible resilient material.

9. The tool defined in claim 1 wherein said tines are disposed adjacent one another, adjacent tines being spaced from one another by a distance less than a width of a fork prong, said tines being sufficiently flexible to permit simultaneous insertion of prongs of a fork between respective adjacent pairs of said tines.

10. The tool defined in claim 1 wherein said insert is nearly coextensive with said pad.

11. A method for cleaning kitchen utensils, comprising:

providing a cleaning pad having a pair of sidewalls defining a pocket therebetween, said sidewalls being formed with a pair of mutually aligned windows, a planar insert being disposed in said pocket, said insert having an aperture aligned with said windows, said aperture being formed with a multiplicity of parallel tines each connected at opposite ends to edges of said planar insert on opposite sides of said aperture;

rubbing an outer surface of said pad against a dish to remove food particles from said dish;

inserting prongs of a fork simultaneously between respective adjacent ones of said tines; and removing said prongs from between said respective adjacent ones of said tines.

12. The method defined in claim 11 wherein the inserting of said prongs between said respective adjacent ones of said times includes orienting said prongs approximately perpendicularly to said tines.

* * * * *